US005957381A

United States Patent [19]

Wakamatsu et al.

[11] Patent Number: 5,957,381

[45] Date of Patent: Sep. 28, 1999

[54] FUEL INJECTION NOZZLE

[75] Inventors: Shinichi Wakamatsu; Yasuhiro Tabata; Kinji Takahashi, all of Higashi-matsuyama, Japan

[73] Assignee: Zexel Corporation, Tokyo, Japan

[21] Appl. No.: 08/941,297

[22] Filed: Sep. 30, 1997

[51] Int. Cl.[6] ..... F02M 47/02

[52] U.S. Cl. ..... 239/88; 239/89; 239/92; 239/96

[58] Field of Search ..... 239/88, 89, 92, 239/96

[56] References Cited

U.S. PATENT DOCUMENTS 4,848,658 7/1989 Aketa et al. ..... 239/88
4,903,896 2/1990 Letsche et al. ..... 239/88
4,934,599 6/1990 Hasagawa ..... 239/88
5,697,554 12/1997 Auwaerter et al. ..... 239/88

*Primary Examiner*—Andres Kashnikow
*Assistant Examiner*—David Deal
*Attorney, Agent, or Firm*—Weneroth, Lind & Ponack, L.L.P.

[57] ABSTRACT

A fuel injection nozzle includes a lift piece located on the side of a nozzle needle. A protrusion of the lift piece and the distal end of a push rod are held by a spring seat with a specified clearance therebetween as a prelift. The adjustment of the prelift can be performed only by taking out the lift piece to be adjusted, so that the adjusting work of the prelift, accompanied with disassembly of the fuel injection nozzle becomes easy and fuel injection characteristics are improved.

5 Claims, 4 Drawing Sheets

FUEL INJECTION NOZZLE

BACKGROUND OF THE INVENTION

The present invention relates to a fuel injection nozzle which injects fuel from an injection hole formed in a nozzle body by the pressure of fuel forcedly fed.

A previous fuel injection nozzle of this type comprises, as shown in FIG. 5, a nozzle needle 105 for opening and closing an injection hole 103 formed in the tip of a nozzle body 121, and a spring 107 for urging the nozzle needle 105 in the direction of closing the injection hole 103. The nozzle body 121 is mounted on a main body 101. In a fuel passage formed in the main body are contained shims 111, 113, a piston 115, a spring seat 117, and a spacer 129, besides the above spring 107. The nozzle body 121 is secured to the main body 101 by a retaining nut 123. On the other hand, in the main body 101 and the nozzle body 121, a fuel passage 125 is formed, and fuel is forcedly fed to the injection hole 103. By the pressure of fuel in the fuel passage 125, the needle nozzle 105 is withdrawn to open the injection hole 103 and to inject fuel from the injection hole 103.

Generally, in this type of fuel injection nozzle, it is effective to restrain the initial injection rate when injecting fuel into a cylinder, for example, in order to decrease NOx and combustion noise of a diesel engine. Therefore, as shown by E in FIG. 5, a clearance for a prelift L1 is defined between the tip portion 127 of the piston 115 receiving a part of pressure (back pressure) in the fuel passage 125 and the spring seat 117. On the other hand, between the nozzle needle 105 and the spacer is established 129, a needle lift L2 (larger than the prelift L1). Because of such arrangements, by the pressure of fuel supplied into the fuel passage 125, the nozzle needle 105 and the spring seat 117 travel through the prelift L1 against the urging force of the spring 107 and a back pressure P applied to the piston 115 in the direction shown by the arrow D1, so that the nozzle needle 105 opens the injection hole 103 (pressure at this time is called the first valve opening pressure) to perform an initial fuel injection at a low injection rate. Thereafter, the nozzle needle 105 and the spring seat 117 further travel through a distance of the needle lift against the urging force of the spring 107 and the back pressure P applied to the piston 115 in the direction of the arrow D1, so that the nozzle needle 105 further opens the injection hole 103 (pressure at this time is called the second valve opening pressure) to perform a stationary fuel injection (main injection) at a high injection rate.

However, the above mentioned previous fuel injection nozzle has the following problems:

(1) When the nozzle needle 105 and the spring seat 117 further travel through the needle lift against the back pressure applied to the piston 115 in the direction of the arrow D1 shown in FIG. 5 by the large pressure of fuel passing through the fuel injection passage 125, the piston 115 releases the shim 111 at the second valve opening pressure and afterward, so that the shim 111 is released from the fixed state and the wear of the shim 111 is liable to occur because of the own vibration of the shim 111. Therefore, when the shim 111 is worn, the tip portion 127 of the piston 115 comes in contact with the spring seat 117 to produce a state where the prelift L1 cannot be ensured. That is, the first valve opening pressure or the initial low injection pressure is lost and a pressure substantially higher than the usual second valve opening pressure comes to be a first valve opening pressure.

Consequently, delay of fuel injection timing and lowering of the fuel injection quantity in a diesel engine occur. In other words, the characteristics of the fuel injection are changed. Such changing in the characteristics of the fuel injection gives a large load to the diesel engine.

(2) Since the state of the shim 111 is unstable, and further, since the piston 115 is supported only on one side by the shim 113, the piston 115 is liable to be inclined from the moving axis for the piston 115, and a cyclic fluctuation in fuel injection performance is liable to occur, and stability thereof is lacking. Consequently, a problem occurs that control of characteristics of fuel injection is difficult.

(3) In a case where the shim 111 is worn and it is necessary to change the shim 111 in adjusting or changing the prelift L1, it is required to remove the nozzle 121, the retaining nut 123, the spacer 129, the spring seat 117, the spring 107, the shim 113, the piston 115, and the shim 111. Consequently, such adjusting operation is very troublesome.

SUMMARY OF THE INVENTION

Therefore, an object of the present invention is to provide a fuel injection nozzle by which changes in characteristics of fuel injection thereof can be avoided and adjustment of the characteristic of fuel injection is easy.

In order to achieve this object, the present invention provides a fuel injection nozzle for injecting fuel from an injection hole by pressure of fuel forcedly fed through a fuel passage, the fuel passage communicating with a back pressure chamber to be received pressure of the fuel in the fuel passage. The nozzle includes a nozzle body having an injection hole formed at a tip thereof; a nozzle needle slidably mounted in the nozzle body, the nozzle needle having a tip portion for opening and closing the injection hole by sliding thereof; a spring arranged on a base end portion side of the nozzle needle, the spring urging the nozzle needle in a direction of closing the injection hole; a spring seat arranged on the base end portion side of the nozzle needle, the spring seat receiving one end portion of the spring and urged toward the nozzle needle; a lift piece located between the spring seat and a base end portion of the nozzle needle; and a push rod having a proximal end portion receiving the pressure of fuel in the back pressure chamber and a distal end portion capable of coming in to contact with a spring-side end portion of the lift piece, a prelift clearance being provided between the spring-side end portion of the lift piece and the distal end portion of the push rod to obtain a prelift of the nozzle needle for initial fuel injection.

According to the fuel injection nozzle described above, as the spring-side end portion of the lift piece located between the spring seat and the base end portion of the nozzle needle, and the distal end portion the push rod define therebetween the prelit clearance for the prelift of the nozzle needle, the prelift clearance is defined on the nozzle needle side, and the influence directly given to the prelift by wear of the lift piece is small. Accordingly, a low initial fuel injection rate can be ensured, and delay of injection timing and lowering of the fuel injection quantity do not occur. Furthermore, although disassembly of the injection nozzle is necessary when adjusting the prelift, the adjustment can be performed merely by removing the component parts on the nozzle needle side which are easy to remove, and therefore, the adjustment operation is simple.

It is desirable that the spring seat includes a guide member for guiding the movement of the push rod. The reason is that the movement of the push rod pushing the lift piece can be guided by the guide member, so that inclination of the axis of the push rod can be prevented, cyclic fluctuation in fuel injection performance can be eliminated, and fuel injection is made stable.

It is desirable that the guide member has a cylindrical hole, and the distal end portion of the push rod is inserted in the cylindrical hole so that the movement of the distal end portion is guided. The reason is that the distal end portion of the push rod can surely be guided by a simple structure.

It is desirable that the lift piece comprises a main body, and a protrusion projecting from the main body as the spring-side end portion thereof, and the protrusion is located in the cylindrical hole of the guide member so that the distal end portion of the push rod and the protrusion of the lift piece face each other in the guide member. The reason is that assembly is easy by inserting the lift piece into the guide member.

It is desirable that the guide member is formed integrally with the spring seat. Since the spring seat guides the distal end of the push rod, the aligning performance of the push rod can be increased and cyclic fluctuation in fuel injection performance can be restrained, so that stable fuel injection characteristics can be obtained. Furthermore, the guide portion formed integrally with the spring seat makes the structure more simple.

It is desirable that the push rod comprises a piston receiving the back pressure of fuel, and a rod, as a separate part from the piston, coming into contact with the piston. The distal end portion of the rod can push the spring-side end portion of the lift piece. Since the rod and the piston are separated, the length of each thereof can be made short, so that inclination of each of the piston and the rod can be decreased and cyclic fluctuation in fuel injection performance is restrained. Consequently, stable fuel injection characteristics can be obtained. Furthermore, since the component parts of the push rod or the piston and the rod are separate members, dimensional adjusting of each part is easy and there is a great deal of flexibility.

It is desirable that the nozzle needle includes a restriction member for restricting travel (needle lift) of the nozzle needle from the closing position of the injection hole to the spring side, and the movement of the nozzle needle determines a main injection quantity of fuel. The reason is that control of the main injection quantity of fuel can easily be performed by adjusting the restriction member.

DESCRIPTION OF THE PREFERRED EMBODIMENTS

In the accompanying figures, FIG. 1 to FIG. 4, the embodiments of the present invention will be described below in detail.

Figure 1:
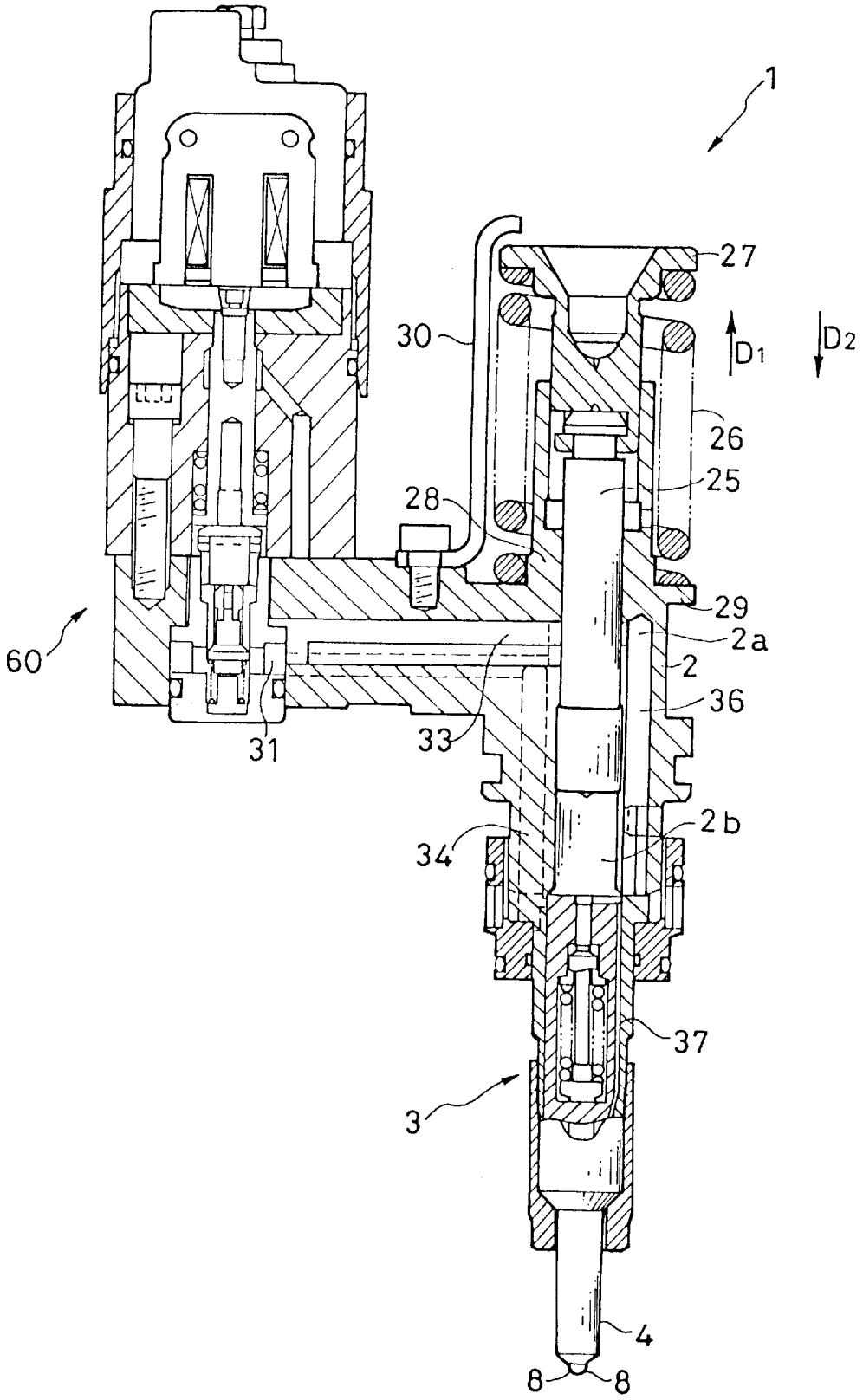
FIG. 1 is a cross sectional view showing a fuel injection device with a fuel injection nozzle according to an example of the present invention.

As shown in FIG. 1, a fuel injection device 1 according to an embodiment of the present invention is used for a diesel engine. The fuel injection device 1 generally comprises a plunger barrel 2 and a fuel injection nozzle 3, and light oil is supplied from a fuel supply force feed portion (feed pump) 60 to the plunger barrel 2. An insertion hole 2*a* is formed in the plunger barrel 2. A plunger 25 for feeding fuel is inserted into the insertion hole 2*a* such that reciprocating motion of the plunger 25 is freely possible in the vertical direction in FIG. 1. The plunger 25 is urged in the upward direction (non-feed direction D1) in FIG. 1 by a plunger spring 26. The spring 26 is arranged between a tappet 27 located on the top of the plunger 25 and a spring receiving step portion 29 formed at the lower part of a cylindrical portion 28 of the barrel 2. At the lower part of the cylindrical portion 28, a preventing member 30 for preventing an excessive movement of the tappet 27 in the non- feed direction D1 is provided. When the tappet 27 travels through not less than a predetermined distance in the upward direction, the tappet 27 comes into contact with the preventing member 30.

A cam face of a rotating cam (not shown) contacts with the upper surface of the tappet 27. The rotating cam is rotated together with an output shaft of the diesel engine and the plunger 25 is reciprocated by the rotation of the rotating cam in the non-feed direction D1 and the feed direction D2.

A fuel supply opening 31 of the fuel supply force feed portion 60 is connected to the insertion hole (inner pressurizing chamber) 2*a* of the plunger barrel 2 through supply passages 33 and 36 of the cylindrical portion 28. The insertion hole 2*a* is connected through a discharge passage 34 to a fuel tank, and an electromagnetic valve (not shown) is inserted in the discharge passage 34 and opens and closes the discharge passage 34. Furthermore, the supply passages 33, 36 are connected to a leak passage 37 of the fuel injection nozzle 3.

Figure 2:
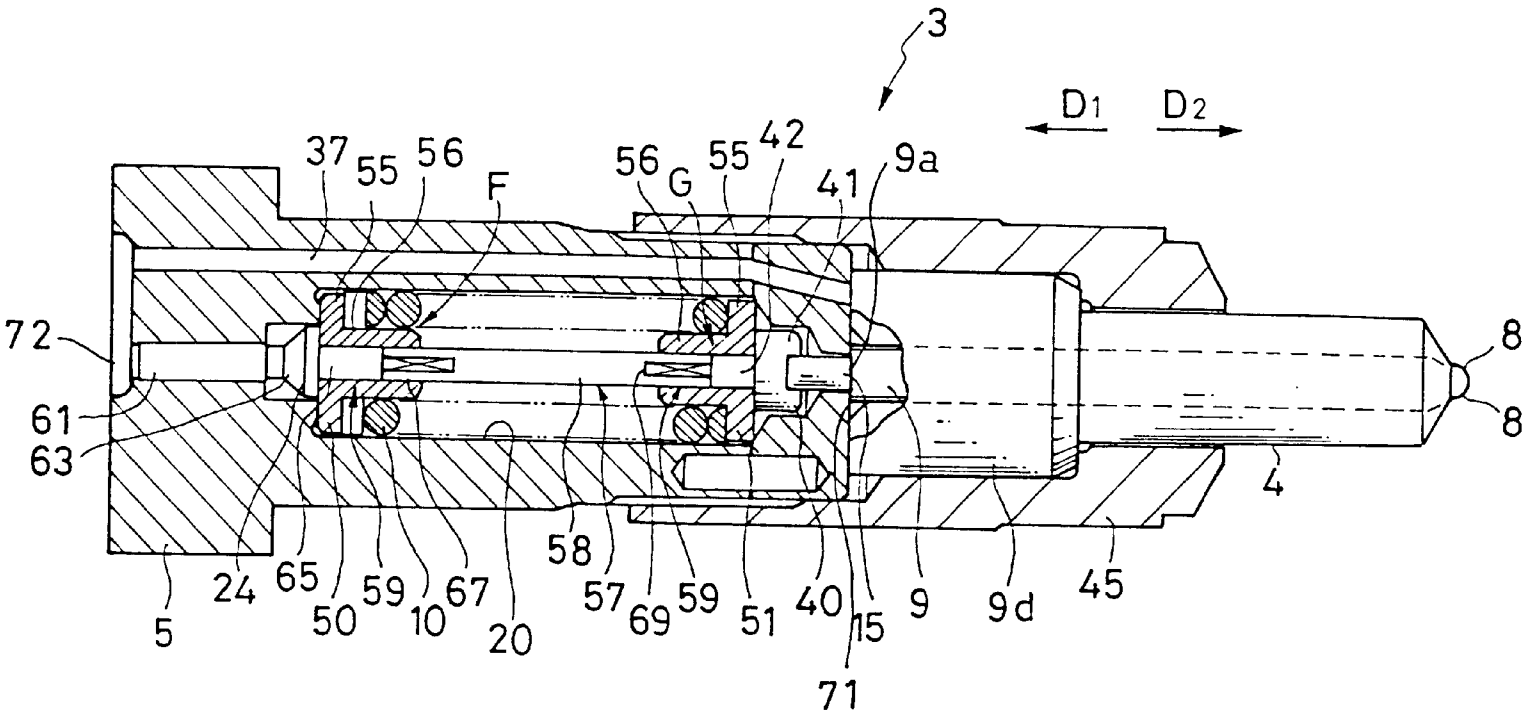
FIG. 2 is a cross sectional view of the fuel injection nozzle shown in FIG. 1.

Next, the structure of the fuel injection nozzle 3 will be described by referring to FIGS. 2–3D. In FIG. 2, the internal structure of the fuel injection nozzle 3 is shown on an enlarged scale, and in FIG. 3A to FIG. 3D the operation of the fuel injection nozzle 3 is shown.

The fuel injection nozzle 3 comprises a nozzle body 4, a retaining nut 45 and a main body 5. The nozzle body 4 is axially connected to the main body 5 by means of the retaining nut 45. In the nozzle body 4, a nozzle needle 9 is arranged such that it reciprocates in the direction D1 (in the direction of opening the injection hole 8) and the direction D2 (in the direction of closing the injection hole 8).

A thin base end portion 15 of the nozzle needle 9 is connected to a lift piece 40, and the lift piece 40 also moves together with the movement of the nozzle needle 9. The lift piece 40 integrally comprises a large diameter portion 41 and a small diameter portion as a protrusion 42, and has a nearly T-shaped cross section. In the large diameter portion 41, the base end portion 15 of the nozzle needle 9 is inserted, and the protrusion 42 is inserted into a guide hole 59 of a spring seat 51 (to be described later) in a spring chamber 20.

In the spring chamber 20, a spring 10, spring seats 50 and 51 located at opposite ends of the spring 10, and a push rod 57 are arranged. The push rod 57 comprises a piston 24 receiving back pressure of fuel in a back pressure chamber 72, and a rod 58 extending from one end of the piston 24 toward the lift piece 40. The rod 58 is formed coaxially with the piston 24, but is a separate member from the piston 24. By separating the push rod 57 into the rod 58 and the piston 24, each length can be made short, and inclination of the axes thereof can be decreased so as to restrain cyclic fluctuations of the fuel injection performance. Furthermore, dimensional adjusting of each part is easy and flexibility is increased.

The spring 10 is located between the two spring seats 50 and 51 and urges the two spring seats 50, 51 in the directions away from each other. One spring seat 50 is located on the side of the piston 24 of the push rod 57 and the other spring seat 51 is located on the side of the lift piece 40.

The two spring seats 50 and 51 have the same shape. Each of the spring seats 50 and 51 comprises a flange portion 55, a cylinder portion 56 and a guide hole 59 axially formed in the nearly central portion of the flange portion 55 and the cylinder portion 56. That is, since the cylinder portion 56 is arranged to guide the rod 58 inserted in the guide hole 59 thereof in the axial direction, the inclination of the axis of the rod 58 can be prevented. Furthermore, since the cylinder portion 56 as the guide portion is formed integrally with the corresponding spring seat, the structure is simple. The flange portion 55 of the spring seat 51 moves in the axial direction in the spring chamber 20.

The piston 24 comprises a shaft portion 61, a large diameter portion 63, and a pushing portion 65 that are integral with one another. The rod 58 is located between the pushing portion 65 of the piston 24 and the protrusion 42 of the lift piece 40. As shown at F and G, one end portion 67 of the rod 58 is inserted in the guide hole 59 of the spring seat 50 so that the movement thereof is guided, and the other end portion (distal end portion) 69 of the rod 58 is inserted in the guide hole 59 of the spring seat 51 so that the movement thereof is guided. The proximal end portion 67 and the distal portion 69 of the push rod 57 are supported by the holes 59 of the two spring seats 50 and 51. Furthermore, the pressure of fuel in the leak passage 37 acts as back pressure on the piston 24 through the back pressure chamber 72 formed on the side of shaft portion 61 of the piston 24.

Figure 3A:
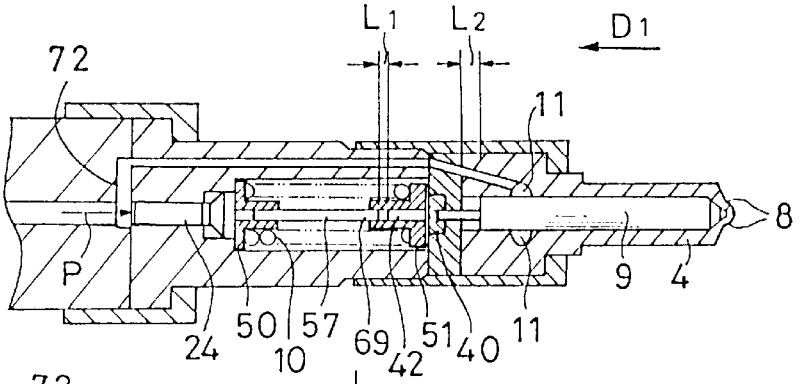
FIG. 3A to FIG. 3D one similar views showing the operation of the fuel injection nozzle shown in FIG. 2.

In a rest state of the fuel injection nozzle, a clearance L1 for a prelift is secured between the distal end portion 69 of the rod 58 and the protrusion 42 of the lift piece 40, as shown in FIG. 3A. The clearance L1 is a gap for the movement or the prelift of the nozzle needle 9 in the direction D1. The prelift L1 is determined by previously adjusting the length of the protrusion 42 of the lift piece 40. Furthermore, on the base end side of the nozzle needle 9, the clearance for a needle lift L2 of the nozzle needle 9 is secured between the base end 9a of the nozzle needle 9 and the restricting member 71. As shown by A-B in FIG. 4, the prelift L1 indicates an initial injection in which fuel is injected at a low injection rate. The needle lift L2 indicates, as shown by D in FIG. 4, a stationary fuel injection (main injection) in which fuel is injected at a high injection rate.

Next, the operation of the fuel injection nozzle 3 according to the present embodiment will be described. When a cyclic operating force is given to the tappet 27 of FIG. 1 by the rotating cam rotated together with the output shaft of the diesel engine, the plunger 25 for feeding fuel reciprocates in the vertical direction of FIG. 1 in the insertion hole 2*a* with aid of the urging force of the plunger spring 26.

When the plunger 25 rises in the direction D1, fuel is introduced from a fuel supply opening 31 (FIG. 1) of the fuel supply force feed portion 60 through the supply passages 33, 36 into a pressurizing chamber. After that, when plunger 25 falls in the feed direction D2, the supply passage 36 is closed by the peripheral surface of the plunger 25 and the electromagnetic valve of the discharge passage 34 is shut, so that the introduced fuel is pressurized by the plunger 25 to be at a high pressure and is delivered to an oil chamber 11 (refer to FIG. 3A) through the fuel passage 37 of the fuel injection nozzle 3.

At the valve closing time in the rest state, as shown in FIG. 3A, the clearance for the prelift L1 is secured between the distal end portion 69 of the rod 58 and the protrusion 42 of the lift piece 40, and the clearance for the needle lift L2 is secured between the restraining member 71 and the base end 9*a* of the nozzle needle 9. In the rest state, the piston 24 receives the back pressure P from the pressurizing chamber 72 shown in FIG. 1, and the piston 24 pushed by the back pressure comes into contact with the spring seat 50. In the rest state, the clearance for the prelift L1 is held between the distal end portion 69 of the push rod 57 and the protrusion portion 42 of the lift piece 40. The termination of the rest state (valve closing time) is indicated by the reference mark A in the graph of the relationship between the fuel injection rate and time shown in FIG. 4.

Figure 3B:
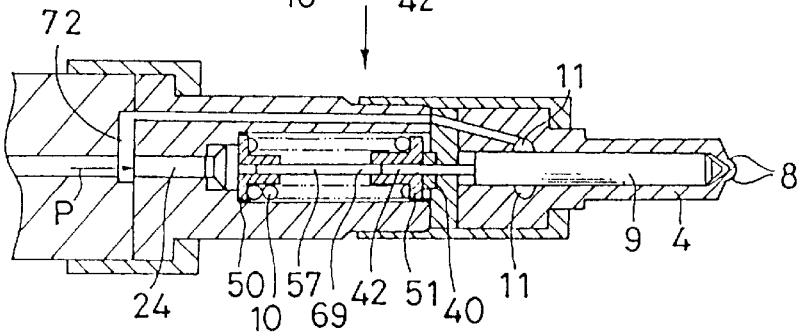

When the pressure in the oil chamber 11 further rises, the nozzle needle 9 overcomes the urging force of the spring 10, and travels through a distance of the prelift L1 in the direction D1 (in the direction of opening the injection hole 8), as shown in FIG. 3B, and the nozzle needle 9 opens the injection hole 8. The change of the injection rate during the movement of the nozzle needle 9 from the state of FIG. 3A to the state of FIG. 3B, that is during the travel of the nozzle needle 9 through a distance of the prelift L1, is shown by A-B in FIG. 4. After the nozzle needle 9 has traveled through the prelift L1, fuel is injected from the injection hole 8 in a state of a low injection rate shown by B-C of FIG. 4.

Figure 3C:
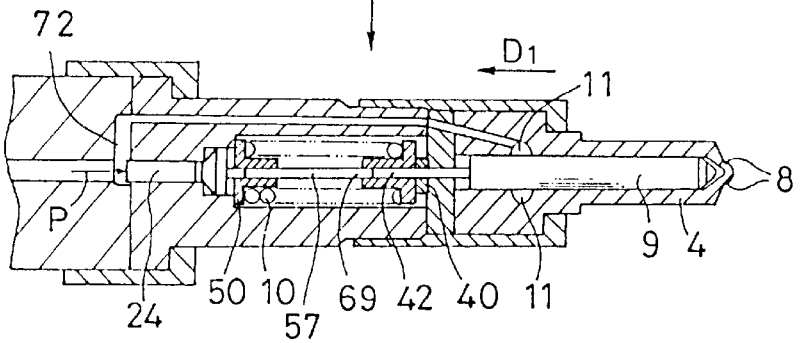
Figure 4:
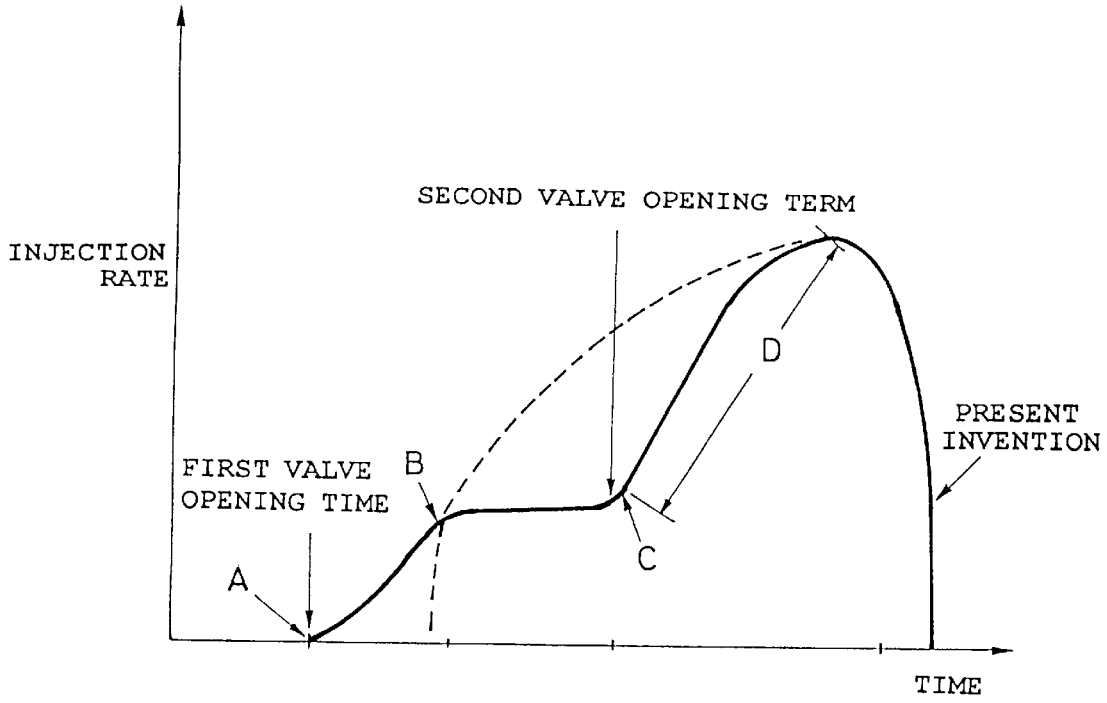
FIG. 4 is a graph showing the relationship between the fuel injection rate and the time during operation of the fuel injection nozzle.
Figure 5:
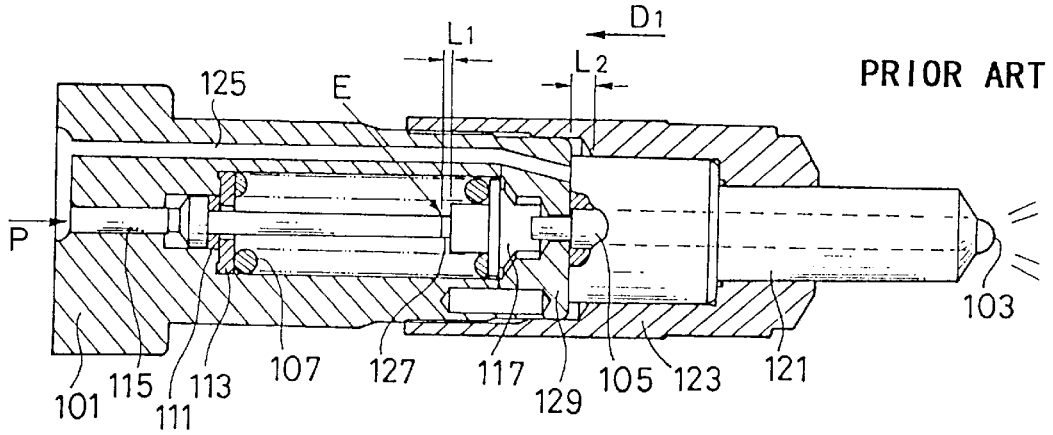
FIG. 5 is a cross sectional view of a previous fuel injection nozzle.

Next, after the initial injection terminates as the second valve opening time C or a second valve opening time as shown in FIG. 4, the nozzle needle 9 further travels in the D1 direction and moves the lift piece 40 and the spring seat 51 toward the piston 24, as shown in FIG. 3C. Thus, piston 24 is moved to the back pressure side, and comes in contact with the body 5, so that further movement is restricted. The nozzle needle 9 further continues withdrawal from the injection hole 8.

Figure 3D:
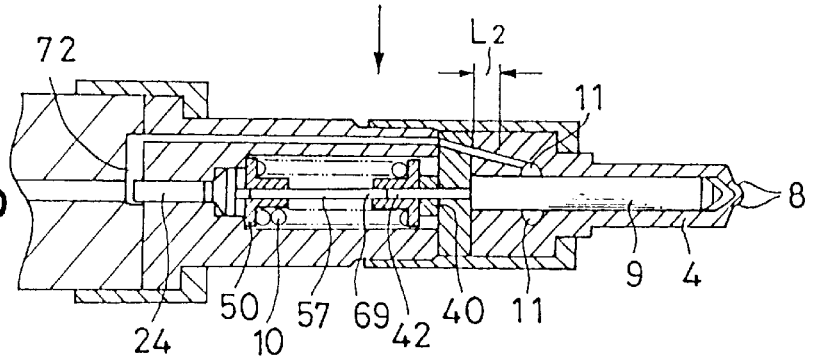

Furthermore, during the term D shown in FIG. 4, the nozzle needle 9 further moves from the state in FIG. 3C to the state in FIG. 3D. The nozzle needle 9 overcomes the sum of the urging force of the spring 10 and the back pressure P, and moves through a distance of the needle lift L2 in the direction D1. During the term D shown in FIG. 4, the main fuel injection from the injection hole 8, that is, the stationary fuel injection at a high injection rate, is performed.

In the above mentioned series of operations, by performing the prelift L1, the initial fuel injection rate can be restricted for reducing NOx and combustion noise of the diesel engine.

In the fuel injection nozzle 3, the prelift L1 is obtained by the clearance between the distal end portion 69 of the rod 58 and the protrusion 42 of the lift piece 40 which is constantly sandwiched between the nozzle needle 9 and the spring seat 51. Therefore, even if wear of the protrusion 42 of the lift piece 40 progresses, the prelift L1 is not decreased contrary to the prior art. Since the prelift L1 can be increased due to the wear, delay of fuel injection timing and lowering of the fuel injection quantity in the diesel engine caused by the reduction or the elimination of the prelift, can be restricted, and it is possible to avoid applying a large load to the diesel engine. Furthermore, a state of fuel injection in a case where there is no prelift L1, is also shown by a broken line in FIG. 4, as a comparative example.

By the way, when adjusting or changing the prelift L1, the adjustment can be performed only by removing the nozzle body 4, the retaining nut 45, the spring 10, the spring seat 51, and the lift piece 40 of FIG. 2, in the above described order, so that the adjusting work can easily be performed.

Since both ends 57 and 59 of the rod 58 are supported by the two spring seats 50 and 51, accuracy of alignment of the push rod 57 can be increased by such two point support. Furthermore, since the piston 24 and the rod 58 are separate members, the lengths of the piston 24 and the rod 58 can be short, and accordingly, the inclination of the axes thereof can be decreased, and variations in the cycle of fuel injection can be restricted, so that stable injection characteristics can be obtained.

The present invention is not limited to the above mentioned embodiment, and various changes can be made without departing from the spirit and the scope of the present invention. For example, the above mentioned fuel injection nozzle is mounted on the fuel injection device of a diesel engine, but it can be applied to other types of internal combustion engines, or appliances of other fields.

Furthermore, in the above mentioned embodiment, the prelift L1 is obtained by the clearance between the distal end portion 69 of the rod 58 and the protrusion 42 of the lift piece 40 on the side of the nozzle needle 9, but it is also possible, without being limited thereto, that a clearance is also defined between pushing portion 65 of the piston 24 and one end portion 67 of the rod 58, and the sum of the clearances is set as the prelift L1.

What is claimed is:

1. A fuel injection nozzle for injecting fuel from an injection hole by pressure of fuel forcedly fed through a fuel passage, the fuel passage communicating with a back pressure chamber and receiving pressure of fuel in the fuel passage, said nozzle comprising:

a nozzle body having said injection hole formed at a tip thereof;

at nozzle needle slidably mounted in said nozzle body, said nozzle needle having a tip portion for opening and closing said injection hole by sliding thereof;

a spring arranged on a base end portion side of said nozzle needle, said spring urging said nozzle needle in a direction of closing said injection hole;

a spring seat arranged at said base end portion side of said nozzle needle, said spring seat receiving one end portion of said spring and urged toward said nozzle needle;

a lift piece located between said spring seat and a base end portion of said nozzle needle;

a push rod having a proximal end portion receiving pressure of fuel in the back pressure chamber and a distal end portion capable of coming into contact with a spring-side end of said lift piece;

a prelift clearance between said spring-side end of said lift piece and said distal end portion of said push rod to define a prelift for an initial fuel injection operation; and said spring seat including a guide member for guiding movement of said distal end portion of said push rod, said guide member having a cylindrical hole, and said distal end portion of said push rod extending into said cylindrical hole so that movement of said distal end portion is guided.

2. A fuel injection nozzle according to claim 1, wherein said spring-side end of said lift piece has a protrusion inserted into said cylindrical hole of said guide member, and said distal end portion of said push rod and said protrusion of said lift piece confronting each other in said cylindrical hole.

3. A fuel injection nozzle according to claim 1, wherein said guide member is formed integrally with said spring seat.

4. A fuel injection nozzle according to claim 1, wherein said push rod comprises a piston receiving back pressure of the fuel, and a rod separate from said piston and having a distal end portion capable of coming into contact with said spring-side end of said lift piece.

5. A fuel injection nozzle according to claim 1, wherein said nozzle further comprises a restraining member for restraining movement of said nozzle needle from a position of closing said injection hole toward said spring, and movement between said restraining member and a closing position of said nozzle needle determines a needle lift indicative of a main injection operation.

* * * * *